US007503881B2

(12) United States Patent
Quick et al.

(10) Patent No.: US 7,503,881 B2
(45) Date of Patent: Mar. 17, 2009

(54) EXERCISE APPARATUS WITH WEIGHT STACKS AND ELASTIC BANDS

(76) Inventors: Leonard Charles Quick, 100 Rosedown Way, Mandeville, LA (US) 70471; Brandt Michael Quick, 100 Rosedown Way, Mandeville, LA (US) 70471

( * ) Notice: Subject to any disclaimer, the term of this patent is extended or adjusted under 35 U.S.C. 154(b) by 539 days.

(21) Appl. No.: 11/120,494

(22) Filed: May 3, 2005

(65) Prior Publication Data

US 2006/0252611 A1 Nov. 9, 2006

(51) Int. Cl.
*A63B 21/062* (2006.01)
*A63B 21/04* (2006.01)
*A63B 21/078* (2006.01)
*A63B 21/072* (2006.01)

(52) U.S. Cl. ..... 482/99; 482/92; 482/102; 482/104; 482/106; 482/130

(58) Field of Classification Search ..... 482/92–94, 482/98–104, 106, 108, 121–123, 129, 130, 482/142
See application file for complete search history.

(56) References Cited

U.S. PATENT DOCUMENTS

| | | | | | |
|---|---|---|---|---|---|
| 684,168 | A * | 10/1901 | Baker | 315/286 |
| 1,804,441 | A * | 5/1931 | Silva | 606/244 |
| 4,149,714 | A * | 4/1979 | Lambert, Jr. | 482/100 |
| 4,598,908 | A * | 7/1986 | Morgan | 482/138 |
| 4,627,615 | A * | 12/1986 | Nurkowski | 482/98 |
| 4,741,529 | A | 5/1988 | Bloemendaal | |
| 4,848,740 | A | 7/1989 | VanDerHoeven | |
| 4,856,773 | A * | 8/1989 | Deola | 482/102 |
| 4,907,798 | A * | 3/1990 | Burchatz | 482/99 |
| 5,135,453 | A * | 8/1992 | Sollenberger | 482/101 |
| 5,152,523 | A * | 10/1992 | Keen | 482/93 |
| 5,256,122 | A | 10/1993 | Deden | |
| 5,304,108 | A | 4/1994 | Denega et al. | |
| 5,328,429 | A | 7/1994 | Potash et al. | |
| 5,476,428 | A | 12/1995 | Potash et al. | |
| 5,509,878 | A | 4/1996 | Denega et al. | |
| 5,725,459 | A * | 3/1998 | Rexach | 482/92 |
| 6,283,899 | B1 | 9/2001 | Charnitski | |
| 6,561,956 | B1 * | 5/2003 | Allison | 482/94 |
| 6,585,491 | B2 | 7/2003 | Taneya et al. | |
| 6,689,024 | B2 | 2/2004 | Charnitski | |
| 7,192,389 | B2 * | 3/2007 | Allison | 482/104 |
| 7,353,780 | B2 * | 4/2008 | Bean | 119/786 |
| 2004/0009854 | A1 * | 1/2004 | Shiang et al. | 482/93 |

FOREIGN PATENT DOCUMENTS

DE 3622705 A1 * 1/1988

(Continued)

*Primary Examiner*—Loan H Thanh
*Assistant Examiner*—Victor K Hwang
(74) *Attorney, Agent, or Firm*—Kenneth L Tolar

(57) ABSTRACT

An exercise machine with a bench press and a pair of weight stacks, which are operationally connected to a lifting bar of a barbell. Pushing motion on the lifting bar transmits the force to a series of wheels connected by flexible bands and to a pair of weight stacks positioned behind the bench press. The weight members of the weight stack are connected by pins, such that upward movement of the uppermost weight members causes pulling force to be applied to successive lower weight members one at a time, thereby allowing incremental increase in the resistance force to the lifting motion of the user.

11 Claims, 7 Drawing Sheets

FOREIGN PATENT DOCUMENTS

| | | | | |
|---|---|---|---|---|
| DE | 4442892 | A1 | * | 6/1996 |
| EP | 194220 | A1 | * | 9/1986 |
| EP | 215172 | A2 | * | 3/1987 |
| EP | 566108 | A1 | * | 10/1993 |
| FR | 2653485 | A2 | * | 4/1991 |
| FR | 2745191 | A1 | * | 8/1997 |
| NL | 1004833 | C6 | * | 6/1998 |
| WO | WO 8000919 | A1 | * | 5/1980 |
| WO | WO 2005016457 | A2 | * | 2/2005 |

* cited by examiner

EXERCISE APPARATUS WITH WEIGHT STACKS AND ELASTIC BANDS

BACKGROUND OF THE INVENTION

The present invention relates to a weight training exercise machine, and more particularly to an exercise machine having a pair of weight stack assemblies with adjustable resistance and elastic bands of varying resistance.

Weight plates and other weight elements are extensively used in the exercise industry; these elements come in various shapes and sizes. However, large weight plates cannot be adjusted for increments of the weight resistance and often jump from 5 to 10 pounds without the possibility of using an increment of weight.

Some of the exercise machines are provided with barbells and bench press assemblies whereby the user positions himself/herself on the bench and lifts the barbells positioned above the bench press. Some of the conventional exercise equipment uses chains and rubber bands, which are stored near the exercise equipment and are assembled for a particular user. This task is often time consuming and arduous. Many of such exercise machines use chains and elastic bands to facilitate exercising muscles in different ways throughout the full range of motion. The chain and cable oftentimes occupy a large space and interfere with the movements of the exercise machine user.

The present invention contemplates elimination of drawbacks associated with the prior art and provision of an exercise machine that allows the user to lift, as well as pull incremental selections of weights while positioned on the bench press.

SUMMARY OF THE INVENTION

It is, therefore, an object of the present invention to provide an exercise machine, which allows lifting and pulling exercises to be combined in one motion of the user.

It is another object of the present invention to provide a compact exercise machine that allows the user to incrementally lift and pull greater weights in one motion, depending on the strength of the user.

It is a further object of the present invention to provide an exercise machine that allows to modify the resistance elements to be pushed/pulled by the user without requiring the user to leave his position on the weight lifting equipment.

These and other objects of the present invention are achieved through a provision of an exercise machine, which allows the user to push barbells upwardly and cause operationally connected weight elements of two weight assemblies to be pulled in sequence, allowing incremental weight resistance to the pushing motion and/or to use elastic bands.

BRIEF DESCRIPTION OF THE DRAWINGS

Reference will now be made to the drawings, wherein like parts are designated by like numerals, and wherein.

DETAILED DESCRIPTION OF THE PREFERRED EMBODIMENT

Figure 1:
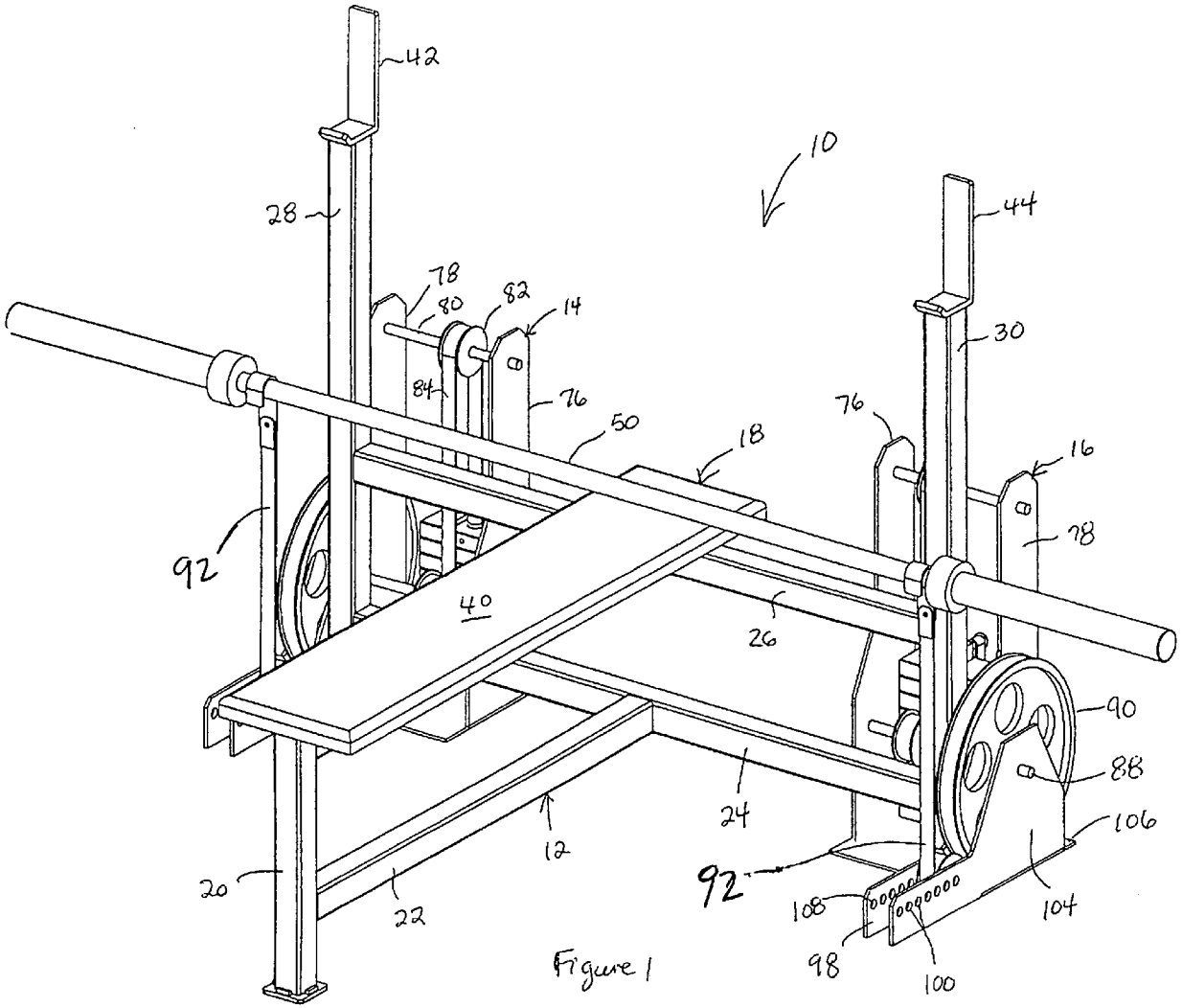
FIG. 1 is a front view of the exercise machine of the present invention, with the barbell assembly lowered and without weight plates.

Turning now to the drawings in more detail, numeral 10 designates the weight exercise machine of the present invention. The apparatus 10 comprises a frame structure 12, a pair of weight assemblies 14 and 16, and a bench 18.

Figure 4:
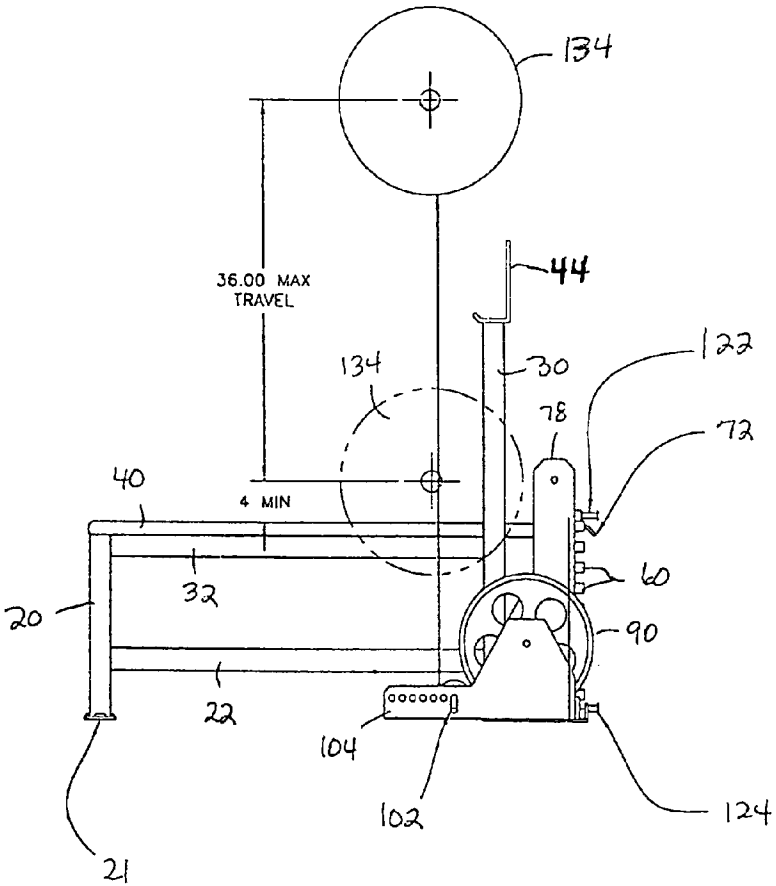
FIG. 4 is a schematic side view of the exercise machine of the present invention with the weight stack extended.

The support frame 12 comprises a first upright support 20 fixedly secured with a first horizontal bar 22, which extends at a right angle to the vertical axis of the upright member 20. The first upright member rests on a front shim plate 21 (FIG. 4), which resists sliding. A second horizontal bar 24 is secured to a free end of the first horizontal bar 22 and extends at the right angle thereto. A third horizontal bar 26 is secured above the second bar 24. Opposite ends of the support bars 24 and 26 are rigidly attached to spaced-apart second upright member 28 and third upright member 30. A bench support bar 32 is attached above the first horizontal bar 22 (see FIG. 4) extending between the first upright support 20 and the third horizontal bar 26. A bench 40 is positioned on top of the bench support bar 32 extending from the first upright member 20 past the edge of the third horizontal bar 26, as can be seen in the drawings.

The second upright member 28 has a hook-shaped rest 42 for a lifting bar 50 of a barbell assembly. A similar hook-shaped rest 44 is secured on top of the third upright member 30 for receiving an opposite end of the lifting bar 50.

Figure 2:
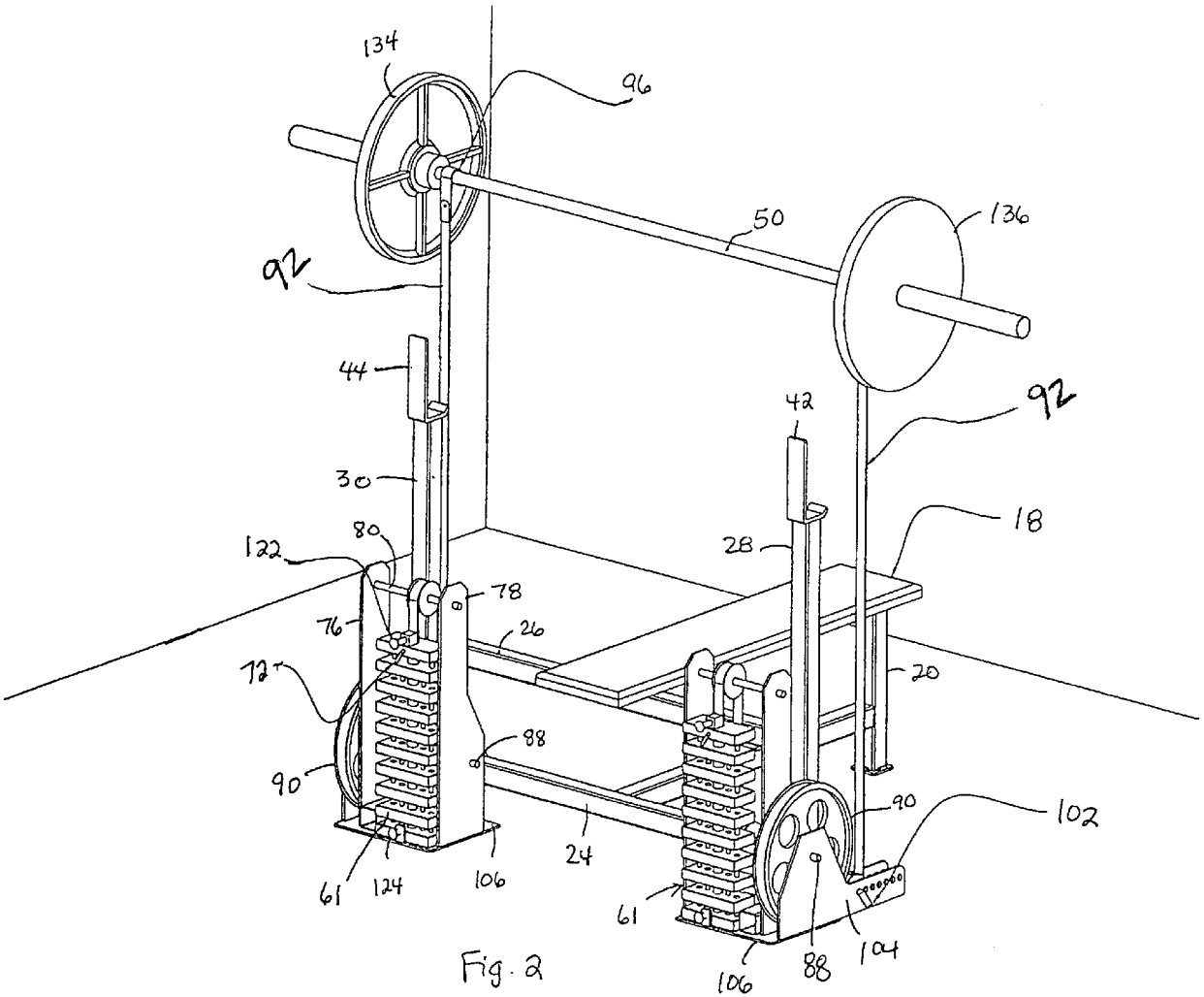
FIG. 2 is a rear view of the exercise machine of the present invention showing the weight members lifted.
Figure 3:
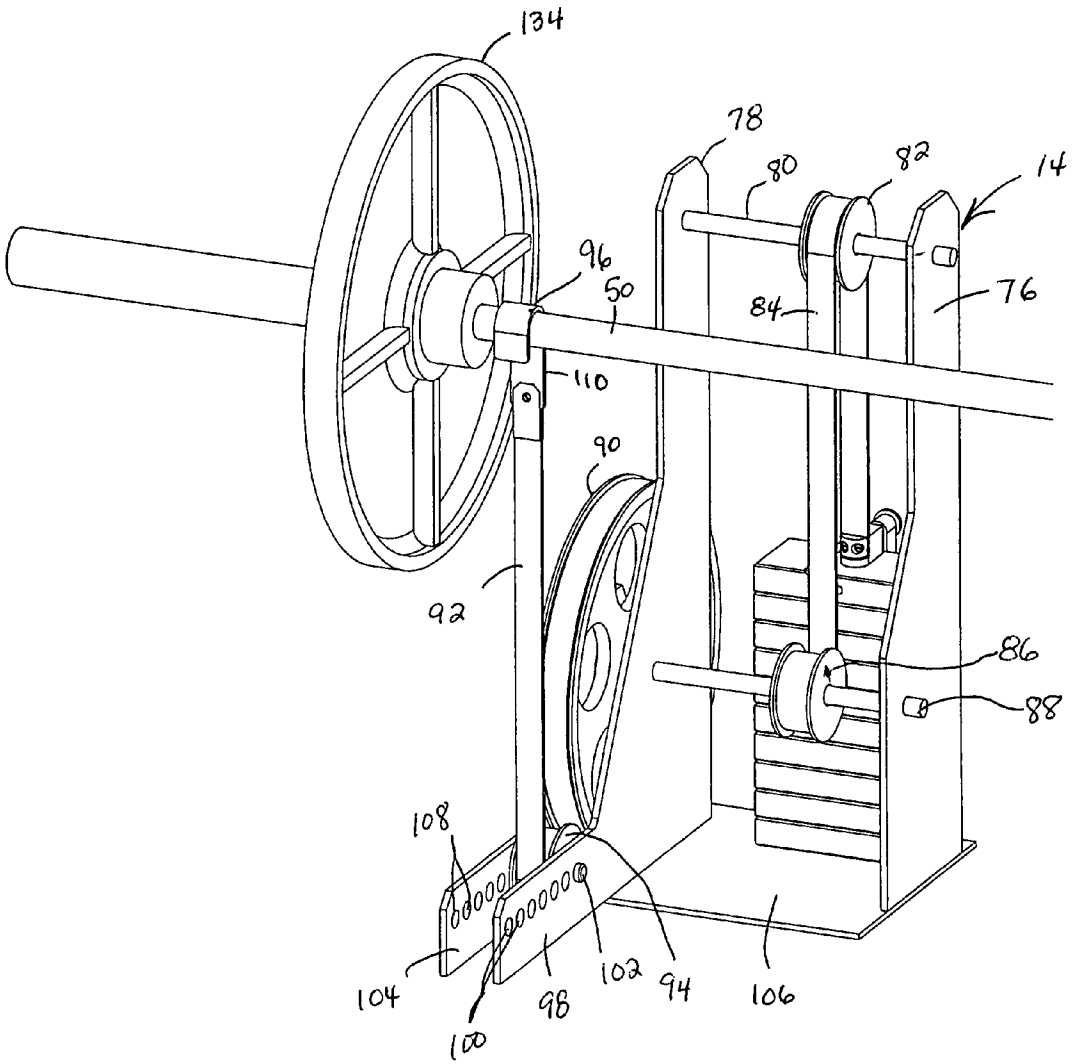
FIG. 3 is a front detail view of the exercise machine of the present invention.
Figure 6:
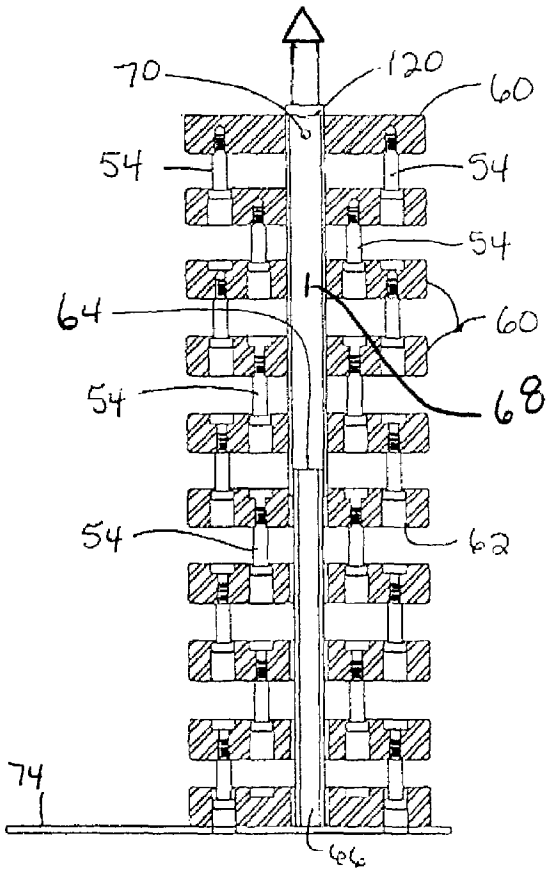
FIG. 6 is a cross-sectional view of the weight stack of the exercise machine of the present invention with the weight members in an extended position.

The weight assemblies 14 and 16 are mirror images of each other, and it will understood that description of structure and operation of the weight assembly 14 applies equally to the second weight assembly 16. The weight assembly 14 comprises a weight stack 61 (FIG. 2) having a plurality of weight members 60 (FIGS. 4, 6 and 7) which are secured together by a plurality of telescopic pins 54 (FIG. 6). The pins 54 extend between the weight members 60 and fit within openings 62 made in the weight members 60.

Figure 5:
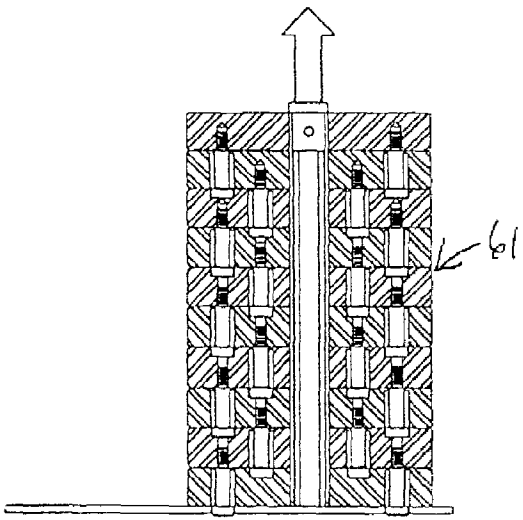
FIG. 5 is a cross-sectional view of the weight stack of the apparatus of the present invention in a non-extended position.
Figure 7:
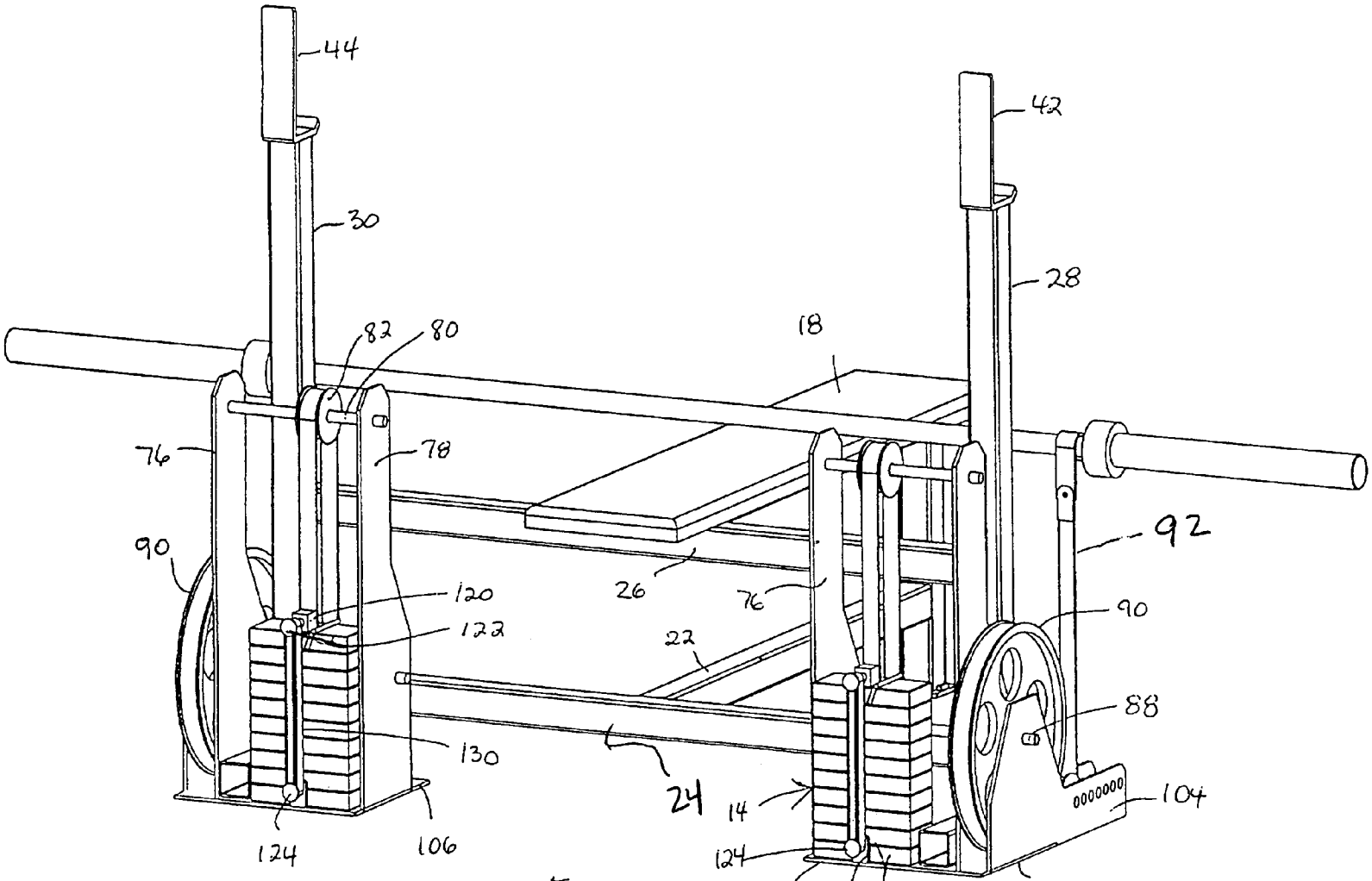
FIG. 7 is a rear view of the exercise machine of the present invention with elastic band in a retracted position.

A tubular guide extends through the center of the weight stack 61. The guide 64 is made of two telescopically engaged members, with the lower telescopic member 66 fitting within an upper telescopic member 68. One or more openings 70 are formed in the upper telescopic member 68 for receiving a locking pin 72 (FIG. 4) therethrough. When the locking pin is inserted in the opening(s) 70, the weight members 60 can be moved in an upward direction. Conversely, when the locking pin 72 is removed or disengaged, the weight members 60 remain stacked together, as shown in FIGS. 5 and 7.

A traveling guide 120 is secured atop the uppermost weight member 60. When an upwardly directed force is applied to the traveling guide 120, the weight members 60 move upwardly in succession, depending on the range of motion of the user. The pins 54 slide within their respective pockets, or openings, causing the weight members to move in sequence one by one. It is envisioned that the pins 54 can be dimensioned such that a distance of less than an inch is created between the bottom of the upper weight member and the top of an adjacent weight member 60. It is also envisioned that about 8 inches of vertical travel can be achieved by lifting the weight stack with the weight members 60.

The weight stack assembly 14 further comprises a base plate 74 on which the bottom of the stack of weight members 60 rest. The weight stack assembly 14 further comprises a pair of upright brackets 76 and 78, which support the weight members 60 on opposite sides. Extending between the upper ends of the brackets 76 and 78 is a rod 80, which carries a pulley 82 thereon. A flexible band 84 is wrapped around the pulley 82 and travels with the rotation of the pulley 82. A second weight assembly pulley 86 is located below the first pulley 82. A free end of the band 84 is wrapped and secured to the pulley 86. The pulley 86 is mounted on a rod 88, which extends through the second bracket member 78 and serves as an axis for a rotating wheel 90.

A lifting band 92 is wrapped around the wheel 90 and travels with the pushing of the lifting bar 50. The band 92 is secured between the bar 50 and the wheel 90. One of the ends of the lifting band 92 is secured to a hook-shaped attachment member 96, which hooks over the lifting bar 50. The second end of the band 92 is lowered to engage a guide 94, which is positioned between parallel brackets 98 and 104 of the weight assembly 14. The brackets rest on the ground forward of the weight stack 61 and form a unitary structure with the bracket 78. The brackets 98 and 104 extend at an approximately right angle to the vertical axis of the bracket 78. The guide 94 is positioned forward of the wheel 90.

The bracket 98 is provided with a plurality of through openings 100 which are formed and configured to receive a turning sheave pin 102. Similar openings 108 are formed though the bracket 104, allowing extension of the pin 102 through the aligned openings 100 and 108. The traveling guide 120 is provided with a slidably vertically moveable hook 122 (FIG. 4), which travels up and down when the locking pin 72 is not engaged within the opening 70. A second hook 124 is fixedly attached to a bracket 126, which is supported by a weight assembly pedestal 106. An elastic band 130 is stretched between the hooks 122 and 124. The elastic band 130 creates a different type of resistance force to the movement of the lifting bar 50.

During use, the user positions himself/herself on the weight bench 18 and grips the lifting bar 50 with both hands. If desired, a pair of weight plates 134 and 136 can be added to increase resistance to the lifting force. The movement of the weight plates 134, 136 can be better seen in FIG. 4, wherein the starting position is shown in phantom lines, and the end position—in solid lines. The flexible strap 92 is hooked to the lifting bar 50 and through the guiding wheel 94, wheel 90, axle 88, pulley 86 and pulley 82, transmits the lifting force to the weight stack members 60. When the locking pin 72 is inserted, the weight members 60 are lifted in succession, starting with the uppermost weight member, in increments as the user pushes the lifting bar 50 farther away from the body. The pushing force on the lifting bar translates into a lifting force on the weight members 60, offering incrementally increasing resistance force. The user can continue pushing the lift the bar 50 until such time as all weight members 60 are extended in a manner shown in FIG. 2. It is envisioned that the lifting bar 50 may be pushed up to 36" upwardly during normal use.

Figure 8:
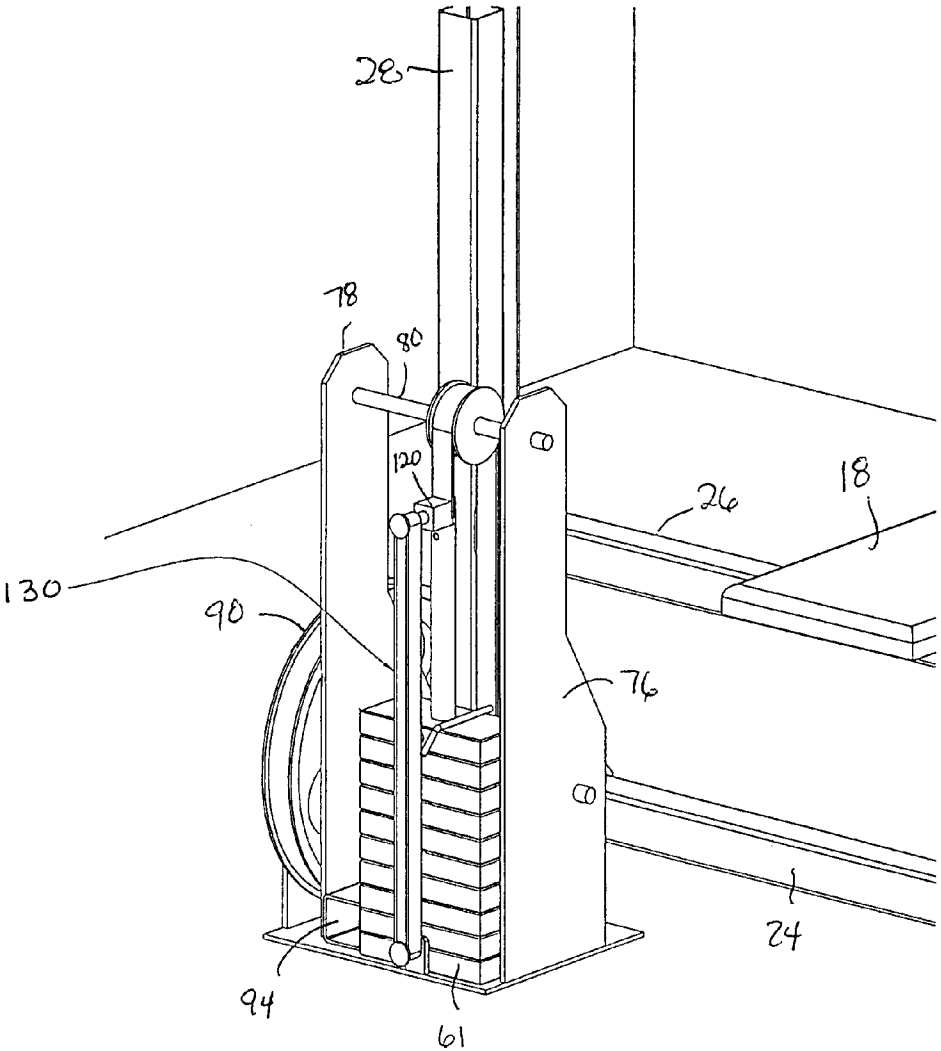
FIG. 8 is a detail view of one of the weight stacks of the apparatus of the present invention with the elastic band extended and the weight stack not moving.

If the locking pin is not inserted into the weight stack, the user can still exert the pushing force on the weight bar 50 against the resistance of the elastic handle 130, which are positioned on the back of each weight stack 61. The band 130 stretches to a position shown in FIG. 8, causing the traveling hook 120 to move with the upper telescopic member 68 while the weight stack 61 does not move.

The user may adjust the mass of the lifted weight by exchanging the weight plates 134 136 carried by opposite ends of the lifting bar 50 to such a level of strength. The user may also use the weight stack 61 or the rubber band 130 as the resisting means for exercising the muscles of the body. The thickness and stretching resistance of the elastic bands 130 can be modified to further increase exercise benefits for the user. The weight members 60 can be modified to further increase/decrease the incremental stepwise resistance provided by this apparatus. The exercise machine of the instant invention provides for a compact unit, which does not require the use of separately stored chains that must be assembled before use. The machine of the instant invention provides for unitized equipment that allows addition of weights at periodic intervals. Many other changes and modifications can be made in the design of the present invention without departing from the spirit thereof. I therefore pray that my rights to the present invention be limited only by the scope of the appended claims.

We claim:

1. An exercise machine comprising:

a base frame having a pair of upright members;

a barbell supportable on said upright members;

at least one weight stack;

means for operably connecting said at least one weight stack to said barbell;

said at least one weight stack formed of an uppermost weight member superimposed on a plurality of underlying weight members directly below said uppermost weight member, said uppermost weight member connected to a first underlying weight member by a first set of at least one telescopic pins and said first underlying weight member is connected to a second underlying weight member directly below said first underlying weight member by a second set of at least one telescopic pins such that lifting the barbell can initially result in only the uppermost weight member exerting resistance against said barbell until said uppermost weight member is lifted a predetermined distance above the first underlying weight member at which time the first underlying weight member will also apply resistance to said barbell and further lifting of said barbell a further predetermined distance will engage the second underlying weight member to also apply resistance to said barbell to provide a workout having an incrementally increased resistance during a given exercise repetition.

2. The exercise machine according to claim 1 further comprising:

an alternate variable resistance means for applying a variable resistance to said barbell in lieu of said weight members.

3. The exercise machine according to claim 2 further comprising means for operationally disconnecting said barbell from said weight stack to allow an exerciser to selectively lift said barbell against only said alternate variable resistance means.

4. The exercise machine according to claim 3 wherein said alternate variable resistance means comprises:

a tubular guide extending through said weight stack, said tubular guide formed of an upper member telescopically receiving a lower member, said upper member operably connected to said barbell;

an upper hook member fixedly attached to said upper member;

a lower hook member fixedly secured proximal a lower end of said weight stack;

an elastomeric band secured to said upper hook member and said lower hook member whereby movement of said barbell extends said guide against a resistance of said band to provide an alternative resistance source to said weight stack.

5. The exercise machine according to claim 4 wherein said means for operationally disconnecting said barbell from said weight stack to allow an exerciser to selectively lift said barbell against a resistance applied by said alternate variable resistance means comprises:

a first aperture on said upper member;

a second aperture on said uppermost weight member;

a pin removably insertable into said first aperture and said second aperture whereby said uppermost weight member moves with said guide as said bar is lifted when said pin is inserted into said first aperture and said second aperture, and said upper member moves independently from said weight stack when said pin is removed from said first aperture and said second aperture.

6. The exercise machine according to claim 4 wherein said means for operably connecting said weight stack to said barbell comprises:

a first pulley positioned above said weight stack;

a second pulley positioned beneath said first pulley and mounted on a rotatable rod;

a drive band having a first end, a second end and an intermediate portion therebetween, the first end secured to said upper member, said second end secured to said second pulley and said intermediate portion engaging said first pulley;

a wheel mounted on said rod;

a lifting band having a first end, a second end and an intermediate portion therebetween, the first end of said lifting band secured to said barbell, the intermediate portion of said lifting band encompassing said wheel and the second end of said lifting band secured thereto whereby upwardly and downwardly motion of said barbell is transferred to said upper guide member to lift and lower said weight stack.

7. The exercise machine according to claim 6 further comprising a hook-shaped attachment member at the first end of said lifting band for removably securing said lifting band to said barbell.

8. The exercise machine according to claim 6 wherein the intermediate portion of said lifting band engages an idler pulley to guide and tension said lifting band.

9. The exercise machine according to claim 8 wherein said idler pulley is selectively repositionable relative to said wheel to vary a position of said lifting band.

10. The exercise machine according to claim 1 wherein each of said at least one telescopic pins includes an upper end and a lower end, said upper end secured to an upper one of said weight members, said lower end slidably received within a pocket formed on a lower one of said underlying weight members.

11. The exercise machine according to claim 1 wherein said barbell includes two opposing ends, each end adapted to receive weighted plates to supplement the resistance applied by said weight stack.

* * * * *